US008850860B2

(12) United States Patent
Nikkuni et al.

(10) Patent No.: US 8,850,860 B2
(45) Date of Patent: Oct. 7, 2014

(54) METHOD OF CONTROLLING OPERATION OF TANDEM ROLLING MILL AND METHOD OF MANUFACTURING HOT-ROLLED STEEL SHEET USING THE SAME

(71) Applicants: Daisuke Nikkuni, Osaka (JP); Suguhiro Fukushima, Osaka (JP); Yoshiro Washikita, Osaka (JP); Tetsuo Kajihara, Tokyo (JP); Kenji Horii, Hiroshima (JP); Taro Sato, Hiroshima (JP)

(72) Inventors: Daisuke Nikkuni, Osaka (JP); Suguhiro Fukushima, Osaka (JP); Yoshiro Washikita, Osaka (JP); Tetsuo Kajihara, Tokyo (JP); Kenji Horii, Hiroshima (JP); Taro Sato, Hiroshima (JP)

(73) Assignees: Nippon Steel & Sumitomo Metal Corporation, Tokyo (JP); Mitsubishi-Hitachi Metals Machinery, Inc., Tokyo (JP)

( * ) Notice: Subject to any disclaimer, the term of this patent is extended or adjusted under 35 U.S.C. 154(b) by 0 days.

(21) Appl. No.: 13/625,283

(22) Filed: Sep. 24, 2012

(65) Prior Publication Data

US 2013/0019646 A1 Jan. 24, 2013

Related U.S. Application Data

(63) Continuation of application No. PCT/JP2011/056926, filed on Mar. 23, 2011.

(30) Foreign Application Priority Data

Apr. 6, 2010 (JP) ..... 2010-087447

(51) Int. Cl.

| | |
|---|---|
| ***B21B 37/16*** | (2006.01) |
| ***B21B 37/72*** | (2006.01) |
| *B21B 1/24* | (2006.01) |

(52) U.S. Cl.

CPC .. *B21B 37/72* (2013.01); *B21B 1/24* (2013.01)
USPC ..... 72/11.8; 72/6.2

(58) Field of Classification Search

USPC ..... 72/6.2, 7.2, 7.5, 8.1, 8.3, 8.4, 8.6–8.9, 72/9.1, 9.2, 10.3, 11.4, 11.8, 12.3, 12.5, 72/12.7, 12.8, 13.5, 14.4, 16.6, 16.7–16.9, 72/18.5–18.8, 7.1, 7.4, 7.6, 8.2; 700/149

See application file for complete search history.

(56) References Cited

U.S. PATENT DOCUMENTS 4,485,497 A * 12/1984 Miura ..... 72/9.2
5,495,735 A * 3/1996 Nishimura ..... 72/16.4

(Continued)

FOREIGN PATENT DOCUMENTS

| | | |
|---|---|---|
| JP | 08-206712 | 8/1996 |
| JP | 2005-319495 | 11/2005 |
| JP | 4266185 | 5/2009 |

OTHER PUBLICATIONS

Hayashi et al., "Development of . . . and Lubrication", Journal of the 1983 Japanese Spring Conference for the Technology of Plasticity, The Japan Society for Technology of Plasticity, 1983, pp. 313-316.

*Primary Examiner* — Shelley Self
*Assistant Examiner* — Pradeep C Battula
(74) *Attorney, Agent, or Firm* — Clark & Brody

(57) ABSTRACT

Provided is a method of controlling operation of a tandem rolling mill which enables large reduction rolling in the latter-stage stand of the tandem rolling mill necessary for manufacturing fine-grained steel, and so on. The method comprises: a step of determining a first exit-side sheet thickness in rolling a constant portion of a material to be rolled; and a step of determining a second exit-side sheet thickness in rolling a front end portion of the material, such that a pre-tightening load becomes a set value or less; the material is rolled into the second exit-side sheet thickness, until the front end portion is fed into the stands; the constant portion is rolled by the stand given a pre-tightening load into the first exit-side sheet thickness; and the second exit-side sheet thicknesses of the stands given the pre-tightening load are made larger than the first exit-side sheet thickness.

6 Claims, 3 Drawing Sheets

(56) References Cited

U.S. PATENT DOCUMENTS 5,609,053 A * 3/1997 Ferreira et al. ..... 72/9.2
6,227,021 B1 * 5/2001 Imanari ..... 72/12.3
6,240,756 B1 * 6/2001 Tsugeno ..... 72/11.8
7,031,797 B2 * 4/2006 Reinschke et al. ..... 72/11.7
8,020,417 B2 * 9/2011 Karam et al. ..... 72/11.8

* cited by examiner

METHOD OF CONTROLLING OPERATION OF TANDEM ROLLING MILL AND METHOD OF MANUFACTURING HOT-ROLLED STEEL SHEET USING THE SAME

TECHNICAL FIELD

The present invention relates to a method of controlling operation of a tandem rolling mill and a method of manufacturing a hot-rolled steel sheet using the same. For example, it relates to a method of controlling operation of a tandem rolling mill in which a tightening load is applied before a front end of a material to be rolled is fed into each stand constituting the tandem finishing mill in a hot rolling line; and a method of manufacturing a hot-rolled steel sheet using the same.

BACKGROUND ART

When a material to be rolled is rolled by a tandem rolling mill comprising a plurality of rolling mills (stands), such as a finishing mill in a hot rolling line, the operation of each stand is determined such that the sheet thickness, sheet width and the like of the material to be rolled on an exit side of a final stand meet a target condition. This operational condition of each stand is called a draft schedule (pass schedule) and has a large influence on the product quality, productivity and the like. It is therefore required to determine a proper draft schedule in accordance with the product.

The draft schedule of the tandem finishing mill in the hot rolling line is usually determined in a way that a rolling load is smaller in a stand in the latter stage (on a downstream side in a traveling direction of the material to be rolled), which is closer to a final product stage, in order to reduce roughness on the surface of a work roll and maintain favorable surface properties of a product. There is a rolling characteristic that even if the same rolling reduction is set in a stand in the earlier stage (on an upstream side in the traveling direction of the material to be rolled) and in the stand in the latter stage, a large rolling load is needed in the latter-stage stand which rolls a material to be rolled with a small sheet thickness. Therefore, in an ordinary draft schedule, rolling reduction is smaller in the latter-stage stand.

On the other hand, a steel material to be used for automobiles, structural materials, and the like is required to have excellent mechanical properties such as strength, workability, and toughness. In order to enhance these mechanical properties comprehensively, it is effective to refine the crystal grains of a hot-rolled steel sheet. If the crystal grains of the hot-rolled steel sheet are refined, it is possible to manufacture a high-strength hot-rolled steel sheet having excellent mechanical properties even if the amount of alloy elements added is reduced.

As a method for refining the crystal grains of the hot-rolled steel sheet, it is known that large reduction rolling (finish rolling in which the rolling reduction in the latter-stage stand is increased) is carried out especially in the latter stage of hot finish rolling to cause large deformation in the austenite grains and to increase a dislocation density, thereby obtaining refined ferrite grains after cooling. In order to manufacture a hot-rolled steel sheet having fine crystal grains (hereinafter, referred to as "fine-grained steel") by this method, it is necessary to increase rolling reduction in the latter-stage stand of the tandem finishing mill in the hot rolling line more than in conventional cases. Accordingly, in order to manufacture the fine-grained steel, it is necessary to determine a draft schedule different from the conventional ones and to control operation of the tandem finishing mill differently from the conventional cases.

Further, especially when carrying out large reduction rolling on a hard material that has a large deformation resistance at a time of being rolled, a rolling load becomes significantly large, and a gap between the upper and lower work rolls due to the elastic deformation of the rolling mill (hereinafter, the gap being referred to as a "rolling mill gap") also becomes large. Therefore, in order to obtain a target exit side sheet thickness, that is, in order to accord the rolling mill gap under the imposition of the rolling load with the target sheet thickness, the gap before the imposition of the rolling load needs to be set small in advance. When the rolling load is large and the target sheet thickness is small, the pre-set gap theoretically becomes minus. In an actual situation, the upper and lower work rolls are contacted with each other (hereinafter, this state is referred to as a "kiss roll".) and are further tightened by a screw-down device to be given a load; and the rolling mill is elastically deformed in advance. In usual hot rolling, the kiss roll itself is rarely needed and the load is minute, so there will not be a problem. However, in the case of the above mentioned fine-grained steel rolling, a tremendously large kiss roll load is generated, thus causing troubles in equipment maintenance. For example, a roll drive system component breaks due to torque circulation attributed to a minute difference in a circumferential speed of the upper and lower work rolls; or when the axes of the upper and lower work rolls are crossed or skewed in the horizontal plane, a roll bearing breaks due to an axial force (hereinafter referred to as a "thrust force") between the rolls. Both of these are caused by direct contact of the upper and lower work rolls, and do not occur if there is a material being rolled between the work rolls, that is, during rolling.

In order to protect the rolling mill, it is necessary to take measures to inhibit the torque circulation or the thrust force even when the kiss roll occurs, or to reduce the kiss roll load itself. However, limiting the pre-tightening in order to reduce the kiss roll load makes it impossible to obtain a target sheet thickness, therefore requiring special operational control of the rolling mill.

As a measure to solve the above problems, Non-Patent Document 1 for example discloses a method in which a lubricant is applied to rolls during kiss roll to reduce a friction force between the rolls. Further, as a technique related to operational control of a rolling mill, Patent Document 1 for example discloses a hot finish rolling method wherein in a hot finishing mill constituted by a plurality of stands, a gap in at least one stand among the continuously arranged stands is enlarged, the method comprising: a first step of starting modification of the gap in the stand when a front end portion of the sheet being rolled that is transported reaches the work rolls of the stand whose gap is to be modified; a second step of rolling the front end portion of the sheet being rolled, into a tapered shape by carrying out the gap modification continuously over time that has been started in the first step, until a preset gap is achieved; and a third step of rolling a constant portion of the sheet being rolled in a constant thickness by keeping the gap constant, after the modification into the preset gap has been done in the second step.

CITATION LIST

Patent Literature

Patent Document 1: Japanese Patent No. 4266185

Non-Patent Literature

Non-Patent Document 1: Kanji Hayashi et al.: "Development of Pair-Cross Type Rolling mill (Seventh Report)—a relation between a thrust force during kiss roll and lubrication", Journal of the 1983 Japanese Spring Conference for the Technology of Plasticity, The Japan Society for Technology of Plasticity, 1983, pp. 313-316

SUMMARY OF INVENTION

Problems to be Solved by the Invention

As disclosed in Non-Patent Document 1, it can be seen that using a lubricant enables reduction of a thrust force which is caused by a load applied during kiss roll and also enables reduction of the so-called torque circulation which is attributed to a minute difference in a circumferential speed of the upper and lower work rolls and which leads to breakage of a drive system component. However, when a lubricant is used that does not degrade the ability of a sheet being rolled to enter the rolls in hot rolling, the effect of drastically lowering the friction coefficient during the hot rolling to reduce the rolling load itself is small. Therefore, when attempting to manufacture fine-grained steel by increasing rolling reduction in the latter-stage stand more than in conventional cases, there arises a problem that a tightening load in a constant portion exceeds an upper limit of the tightening load for the time of kiss roll. Patent Document 1 describes a method that the gap in the rolling mill is modified during rolling; however, it does not relate to a gap modification starting from the state of kiss roll, and does not describe a method of determining each gap at a time of transition from the state of kiss roll to constant rolling. As such, it is difficult to start controlling operation of a tandem rolling mill in the state of kiss roll, by using the technique disclosed in Patent Document 1; and it is impossible to carry out large reduction rolling in the latter-stage stand that is necessary for manufacturing a fine-grained steel sheet.

Accordingly, an object of the present invention is to provide: a method of controlling operation of a tandem rolling mill which enables large reduction rolling in the latter-stage stand of the tandem rolling mill that is necessary for manufacturing fine-grained steel and the like; and a method of manufacturing a hot-rolled steel sheet using the same.

Means for Solving the Problems

The present invention will be described below. Although the reference symbols given in the accompanying drawings are shown in parentheses to make the present invention easy to understand, the invention is not limited to an embodiment shown in the drawings.

A first aspect of the present invention is a method of controlling operation of a tandem rolling mill (10) which comprises N stands (1, 2, . . . , 7) (N being an integer of 2 or more) and in which a tightening load is pre-applied to each of the (N−m+1)-th stand (m being an integer of one or more and N or less) to the N-th stand (7) before a material (8) to be rolled is fed thereinto, the method comprising an exit side sheet thickness determination step (S1) of determining a sheet thickness on an exit side of each of the first stand (1) to the N-th stand (7), wherein the exit side sheet thickness determination step comprises: a first exit side sheet thickness determination step (S11) of determining sheet thicknesses on the exit sides of the first stand (1) to the N-th stand (7) at a time of rolling a constant portion of the material to be rolled; and a second exit side sheet thickness determination step (S15) of determining sheet thicknesses on the exit sides of the first stand (1) to the N-th stand (7) at a time of rolling a front end portion of the material to be rolled, such that the tightening load to be pre-applied to the stands (5, 6, 7) becomes a preset tightening load or less; the material (8) to be rolled is rolled to have the exit side sheet thickness determined in the second exit side sheet thickness determination step, until at least the front end portion of the material to be rolled is fed into each of the stands; the constant portion of the material to be rolled is rolled by the (N−m+1)-th stand (5) to the N-th stand (7) to have the exit side sheet thickness determined in the first exit side sheet thickness determination step; and the sheet thicknesses on the exit sides of the (N−m+1)-th stand (5) to the N-th stand (7) determined in the second exit side sheet thickness determination step are larger than the sheet thicknesses on the exit sides of the same stands determined in the first exit side sheet thickness determination step.

Herein, the "N-th stand (7)" refers to a final stand of the tandem rolling mill (10), that is, a stand (7) of the tandem rolling mill (10) disposed on a downstream end in the traveling direction of the material (8) to be rolled by the tandem rolling mill. The "first stand (1)" refers to a stand (1) of the tandem rolling mill (10) disposed on an upstream end in the traveling direction of the material (8) to be rolled by the tandem rolling mill. Further, in the present invention, the "front end portion of the material (8) to be rolled" refers to a portion rolled before the operation of the rolling mill to meet the first exit side sheet thickness determination step (S11) is started. Additionally, in the present invention, the "constant portion of the material (8) to be rolled" refers to a portion to be rolled after the operation of the rolling mill to meet the first exit side sheet thickness determination step (S11) is completed. The sentence "the sheet thicknesses on the exit sides of the (N−m+1)-th stand (5) to the N-th stand (7) determined in the second exit side sheet thickness determination step are larger than the sheet thicknesses on the exit sides of the same stands determined in the first exit side sheet thickness determination step" means that each sheet thickness on the exit side of each of the (N−m+1)-th stand (5) to the N-th stand (7) is determined such that the exit side sheet thicknesses determined in the second exit side sheet thickness determination step become larger than the exit side sheet thicknesses determined in the first exit side sheet thickness determination step.

Further, in the above first aspect of the present invention, in transition from the front end portion to the constant portion of the material to be rolled, a change in the shape of the stand (7) is preferably predicted based on a change in a rolling load from the front end portion to the constant portion; and operation of a shape control device (7*x*, 7*y*) of the stand is preferably controlled based on the predicted change in the shape.

Herein, in the present invention, the "shape control device (7*x*, 7*y*) of the stand" refers to an actuator exemplified by an actuator (7*x*) capable of modifying a crossing angle of work rolls (7*a*, 7*a*), and a roll bender device (7*y*) capable of modifying a bending force to be applied to the work rolls (7*a*, 7*a*).

Furthermore, the above first aspect of the present invention may have the following configuration: the stands (5, 6, 7) to be pre-applied with the tightening load comprise two or more shape control devices (5*x*, 5*y*, 6*x*, 6*y*, 7*x*, 7*y*); the two or more shape control devices include a first shape control device (5*x*, 6*x*, 7*x*) and a second shape control device (5*y*, 6*y*, 7*y*) which is capable of high-speed operation at least at the time of transition from the front end portion to the constant portion of the material to be rolled; the operation of the second shape control device is predicted before the transition from the front end portion to the constant portion of the material to be rolled; and based on the prediction result, the operations of the first shape control device and the second shape control device are set such that a permissible operation range of the second shape control device is not exceeded.

Here, in the present invention, the phrase "capable of high-speed operation" means that the operation of the shape control device can be completed with almost no delay of time in response to the change in the rolling load associated with the change in the rolling mill gap and the like.

Moreover, in the above first aspect of the present invention, the stands (5, 6, 7) to be pre-applied with the tightening load preferably comprise a first shape control device (5*z*, 6*z*, 7*z*) and a second shape control device (5*y*, 6*y*, 7*y*) which are capable of high-speed operation at least at the time of transition from the front end portion to the constant portion of the material to be rolled; and in a case when a permissible operation range of the first shape control device is exceeded, the operation of the second shape control device is preferably modified.

Additionally, in the above first aspect of the present invention, the exit side sheet thickness determination step (S1) preferably further comprises a third exit side sheet thickness determination step (S16) of determining sheet thicknesses on the exit sides of the first stand (1) to the N-th stand (7) such that the tightening load on the stands at the time of completing rolling of a back end portion of the material to be rolled becomes a preset tightening load or less.

Herein, the "back end portion of the material to be rolled" refers to a tail end side portion of the material (8) to be rolled, which is positioned on a more upstream side in the traveling direction of the material (8) to be rolled, than the constant portion of the material (8) to be rolled.

A second aspect of the present invention is a method of manufacturing a hot-rolled steel sheet comprising the step of rolling a steel sheet (8) by using a row (20) of hot finishing mills the operation of which is controlled by the method of controlling operation of a tandem rolling mill according to the above first aspect of the present invention.

Effects of the Invention

The first aspect of the present invention comprises the second exit side sheet thickness determination step of determining the sheet thickness on the exit side of each stand at the time of rolling the front end portion of the material to be rolled such that the tightening load to be pre-applied to the stand becomes a preset tightening load or less; and the sheet thicknesses on the exit sides of the (N−m+1)-th stand to the N-th stand determined in the second exit side sheet thickness determination step are larger than the sheet thicknesses on the exit sides of the same stands determined in the first exit side sheet thickness determination step. Therefore, according to the first aspect of the present invention, even in a case of carrying out large reduction rolling, it is possible to control the tightening load during kiss roll to be not larger than a tightening load determined in view of equipment maintenance, by adjusting the roll gap in a way that the exit side sheet thickness of the front end portion of the material to be rolled by the stand pre-applied with the tightening load becomes larger than the exit side sheet thickness of the constant portion. Therefore, by applying the first aspect of the present invention to the row (20) of hot finishing mills, it is possible to provide a method of controlling operation of a tandem rolling mill which enables manufacturing of fine-grained steel. Further, the second aspect of the present invention comprises the step of rolling the steel sheet (8) by using the row (20) of hot finishing mills the operation of which is controlled by the method of controlling operation of a tandem rolling mill according to the above first aspect of the present invention. Therefore, according to the second aspect of the present invention, it is possible to provide a method of manufacturing a hot-rolled steel sheet which enables manufacturing of fine-grained steel.

MODES FOR CARRYING OUT THE INVENTION

Hereinafter, the mode for carrying out the present invention will be described with reference to the drawings.

Figure 1:
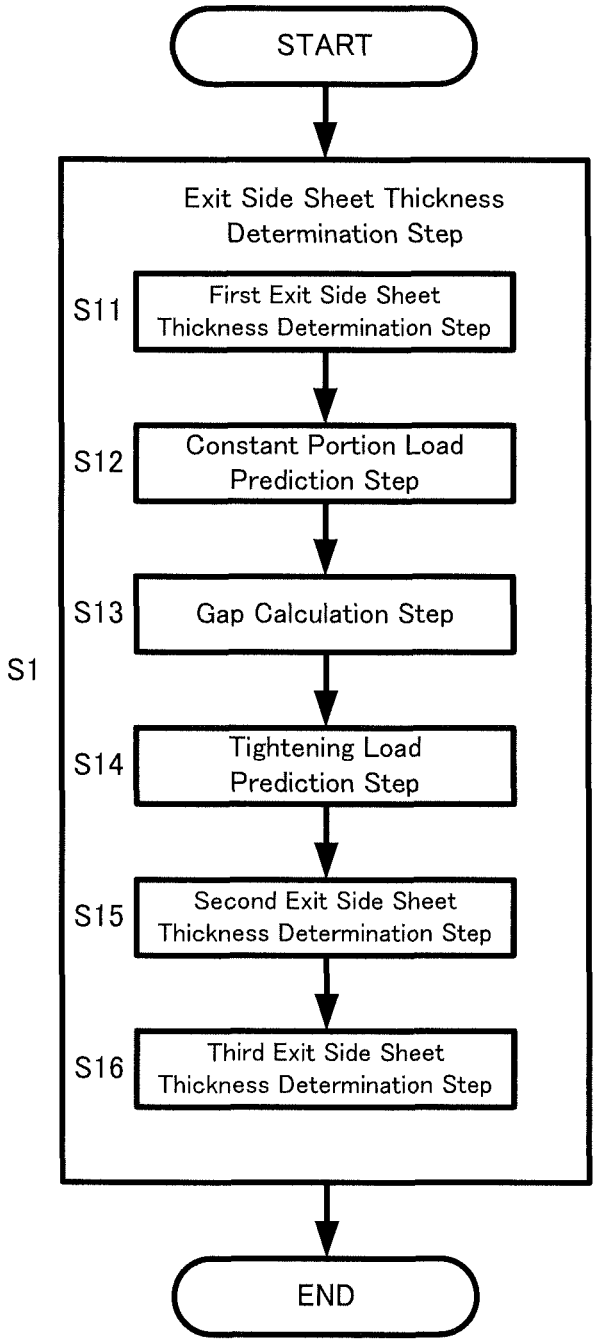
FIG. 1 is a flow chart showing a configuration example of the method of controlling operation of a tandem rolling mill according to the present invention.

FIG. 1 is a flow chart showing a configuration example of the method of controlling operation of a tandem rolling mill according to the present invention (hereinafter sometimes referred to as an "operation control method of the present invention"). The operation control method of the present invention shown in FIG. 1 comprises an exit side sheet thickness determination step (hereinafter sometimes referred to as "S1"). S1 includes: a first exit side sheet thickness determination step (S11); a constant portion load prediction step (S12); a gap calculation step (S13); a tightening load prediction step (S14); a second exit side sheet thickness determination step (S15); and a third exit side sheet thickness determination step (S16). Namely, in the operation control method of the present invention, the operation of the tandem rolling mill is controlled through S1 comprising these steps.

Figure 2:
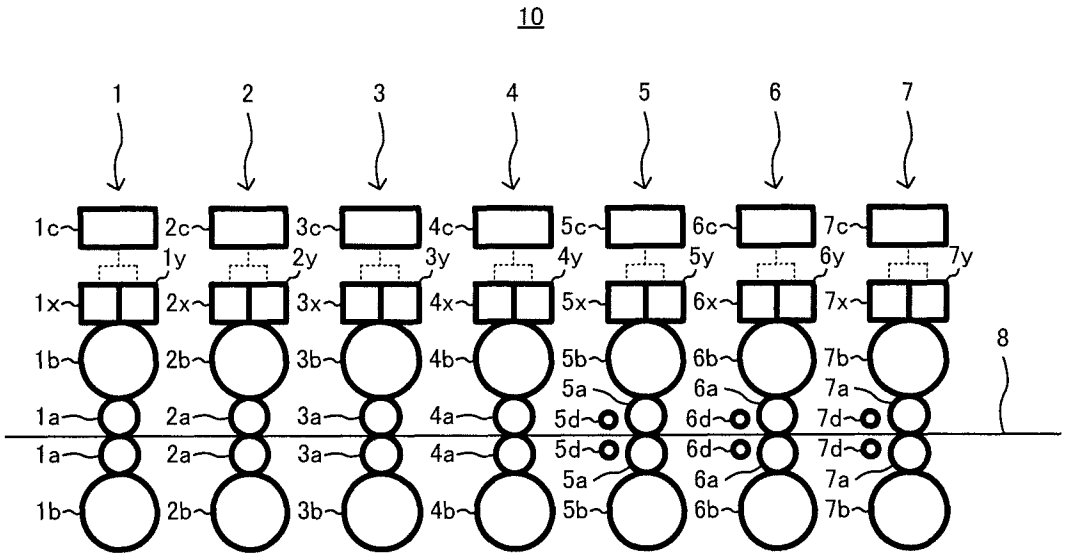
FIG. 2 is a view showing a configuration example of a tandem rolling mill 10 the operation of which is controlled by the method of controlling operation of a tandem rolling mill according to the present invention.

FIG. 2 is a view of a configuration example of a tandem rolling mill 10 the operation of which is controlled by the operation control method of the present invention. FIG. 2 shows a simplified view of the configuration of the tandem rolling mill 10. As shown in FIG. 2, the tandem rolling mill 10 comprises seven stands that are a first stand 1, a second stand 2, . . . , and a seventh stand 7; and is configured to be capable of continuously roll a material 8 to be rolled (hereinafter sometimes referred to as a "steel sheet 8") using these seven stands of the first stand 1 to the seventh stand 7. Each of these seven stands 1, 2, . . . , 7 is provided with: a pair of work rolls; a pair of backup rolls; an actuator which modifies a crossing angle of the rolls; and a roll bender device which gives a bending force to the rolls. The operations of these are controlled by a control device. That is, the first stand 1, for example, is provided with a pair of work rolls 1*a*, 1*a*, a pair of backup rolls 1*b*, 1*b*, an actuator 1*x*, and a roll bender device 1*y*; and the operations of the work rolls 1*a*, 1*a* and the backup rolls 1*b*, 1*b* are controlled via the actuator 1*x* and the roll bender device 1*y*, the operations of which are controlled by the control device 1*c*. Likewise, the seventh stand 7, for example, is provided with a pair of work rolls 7*a*, 7*a*, a pair of backup rolls 7*b*, 7*b*, an actuator 7*x*, and a roll bender device 7*y*; and the operations of the work rolls 7*a*, 7*a* and the backup rolls 7*b*, 7*b* are controlled via the actuator 7*x* and the roll bender device 7*y*, the operations of which are controlled by the control device 7*c*. In the tandem rolling mill 10, the control devices 1*c*, 2*c*, . . . , 7*c* are known process computers. With reference to FIGS. 1 and 2, the operation control method of the present invention will be described below in detail in terms of a case of N=7 and m=3, which is one embodiment of the present invention.

<Exit Side Sheet Thickness Determination Step: S1>

S1 is a step of determining each sheet thickness on the exit side of each of the first stand to the N-th stand (N being an integer of two or more). That is, in the case of N=7 and m=3, S1 is a step of determining each sheet thickness on the exit side of each of the first stand 1 to the seventh stand 7. In the operation control of the present invention, the configuration of S1 is not particularly limited as long as it comprises at least below described S11 and S15.

<First Exit Side Sheet Thickness Determination Step: S11>

The first exit side sheet thickness determination step (hereinafter sometimes referred to as "S11") is a step of determining sheet thicknesses on the exit sides of the first stand to the N-th stand at a time of rolling the constant portion of the material to be rolled. That is, in the case of N=7, S11 can be a step of determining the sheet thicknesses h1 to h7 on the exit sides of the first stand 1 to the seventh stand 7 at a time of rolling the constant portion of the steel sheet 8. In the operation control method of the present invention, the constant portion of the steel sheet 8 refers to a portion to be rolled after operation of the rolling mill to meet Sil is completed.

In the operation control method of the present invention, the configuration of S11 is not particularly limited as long as it is a step of determining each of the sheet thicknesses h1 to h7 on the exit sides of the first stand 1 to the seventh stand 7 at the time of rolling the constant portion of the material 8 to be rolled.

<Constant Portion Load Prediction Step: S12>

The constant portion load prediction step (hereinafter sometimes referred to as "S12") is a step of predicting a load to be applied to the constant portion of the material to be rolled when the first stand to the N-th stand are operated so as to attain the exit side sheet thicknesses determined in S11 above. That is, in the case of N=7, S12 can be a step of predicting a load to be applied to the constant portion of the steel sheet 8 when the first stand 1 to the seventh stand 7 are operated so as to attain the exit side sheet thicknesses h1 to h7 determined in S11 above. The prediction result in S12 will be used in the below described gap calculation step.

<Gap Calculation Step: S13>

The gap calculation step (hereinafter sometimes referred to as "S13") is a step of calculating, based on the load predicted in S12 above, a rolling mill gap (roll gap) of the first stand to the N-th stand at the time of rolling the constant portion of the material to be rolled. That is, in the case of N=7, S13 can be a step of calculating, based on the load predicted in S12 above, a rolling mill gap (roll gap) of the first stand 1 to the seventh stand 7 at the time of rolling the constant portion of the steel sheet 8.

<Tightening Load Prediction Step: S14>

The tightening load prediction step (hereinafter sometimes referred to as "S14") is a step of predicting a tightening load to be pre-applied to each of the (N−m+1)-th stand to the N-th stand while taking into consideration the relation between the gap calculated in S13 above and the tightening load. That is, in the case of N=7 and m=3, S14 can be a step of predicting a tightening load to be pre-applied to each of the fifth stand 5 to the seventh stand 7 while taking into consideration the relation between the gap calculated in S13 above and the tightening load.

<Second Exit Side Sheet Thickness Determination Step: S15>

The second exit side sheet thickness determination step (hereinafter sometimes referred to as "S15") is a step of determining sheet thicknesses on the exit sides of the first stand to the N-th stand at a time of rolling the front end portion of the material 8 to be rolled, such that the tightening load to be pre-applied to the stand becomes a preset tightening load or less. When the tightening load to be pre-applied (during kiss roll) to each of the (N−m+1)-th stand to the N-th stand exceeds an upper limit of the tightening load set in view of equipment maintenance, pre-applying the tightening load while maintaining the set value of the rolling mill gap of each stand is likely to cause breakage of a speed reducing device, rolling rolls, and the like. Therefore, in the operation control method of the present invention, when the pre-tightening load predicted in S14 above exceeds the upper limit of the tightening load set in view of equipment maintenance, with the mill modulus and the plastic property taken into consideration, the sheet thickness on the exit side of the stand in which the predicted value obtained in S14 exceeds the upper limit is modified to be larger than the exit side sheet thickness determined in S11, to increase the set value of the rolling mill gap of the stand in which the pre-tightening load exceeds the upper limit; and thereby the pre-tightening load is made to be not larger than the upper limit. By doing so, even when large reduction rolling is carried out, the rolling can be done in a manner preventing breakage of each stand. In the operation control of the present invention, the front end portion of the material 8 to be rolled refers to a portion rolled before operation of the rolling mill to meet S11 is started.

<Third Exit Side Sheet Thickness Determination Step: S16>

The third exit side sheet thickness determination step (hereinafter sometimes referred to as "S16") is a step of determining sheet thicknesses on the exit sides of the first stand to the N-th stand such that the tightening load on the stand at a time of completing rolling of the back end portion of the material to be rolled becomes a preset tightening load or less. When rolling a material to be rolled, the kiss roll state occurs not only before the rolling is started but also after the rolling is completed. Therefore in S16, when it is expected that the tightening load to be applied under the state of kiss roll after completion of the rolling would exceed the upper limit of the tightening load set in view of equipment maintenance, with the mill modulus and the plastic property taken into consideration, the setting is modified in a way that the sheet thickness on the exit side of the stand in which the tightening load has exceeded the upper limit becomes larger than the exit side sheet thickness determined in S11, so as to increase the set value of the rolling mill gap of the stand at the time of rolling the back end portion of the material to be rolled. With S16, equipment maintenance of each stand can be easily ensured.

Herein, the operation of the tandem rolling mill 10 which rolls the steel sheet 8 will be for example as follows in a case when the value of the pre-tightening load predicted in S14 above is less than the upper limit in the fifth stand 5 and in the sixth stand 6, and on the other hand has exceeded the upper limit in the seventh stand 7. First, the tandem rolling mill 10 is set up by operating the control devices 1*c* to 7*c* such that the sheet thicknesses on the exit sides of the first stand 1 to the sixth stand 6 becomes the exit side sheet thicknesses h1 to h6 of the front end portion determined in S11 and such that the sheet thickness on the exit side of the seventh stand 7 becomes the exit sheet thickness h7' (>h7) set after modification in S15. Then, rolling is started. The control device 7*c* is operated, at a predetermined timing after the front end portion is fed into the seventh stand 7, such that the sheet thickness on the exit side of the seventh stand 7 becomes the exit side sheet thickness h7 of the constant portion determined in S11, then moving onto rolling of the constant portion. A specific method may be for example to calculate the exit side sheet thickness from the actual values of the rolling load and the rolling reduction position, apply the so-called absolute value AGC to control the rolling reduction position so as to match the exit side sheet thickness with a target sheet thickness, and then modify the target sheet thickness from h7' to h7. As to the predetermined timing (to operate the control device 7*c*), any timing may be selected as long as it is after the front end portion of the material to be rolled is fed into the seventh stand 7. For example, the time after the front end portion is fed into the seventh stand 7 and before the control device 7*c* is operated may be pre-specified.

When it is expected that the tightening load after completion of the rolling would exceed the upper limit, the set value of the gap of the stand in which the tightening load is expected to exceed the upper limit may be modified into the set value calculated in S16 above, just before rolling the rear end portion of the material to be rolled. The negative effect of the excessive tightening load during kiss roll can be prevented not only immediately before passing of the front end portion of the material to be rolled but also immediately after the rolling.

Below are shown specific examples of the sheet thicknesses h1 to h7 on the exit sides of the first stand 1 to the seventh stand 7 at the time of rolling the constant portion of the steel sheet, determined in S11 above; and specific examples of the sheet thicknesses h1 to h7' on the exit sides of the first stand 1 to the seventh stand 7 at the time of rolling the front end portion of the steel sheet, determined in S15 above. In the two embodiments shown below, it was supposed that: a tightening load was pre-applied to three stands of the fifth stand 5 to the seventh stand 7; the load limit of the fifth stand 5 during kiss roll was 15.68 MN; and the load limit of the sixth stand 6 and the seventh stand 7 during kiss roll was 12.74 MN. Further, it was supposed that: a work roll crown was given that would produce flatness of the constant portion of the steel sheet under the rolling conditions thereof; and for the front end portion of the steel sheet, a bending force to be applied to the work rolls by the roll bender device was modified so that the rolling load difference between the front end portion and the constant portion of the steel sheet would be compensated for to ensure flatness of the front end portion of the steel sheet. Hereinafter, the bending force to be applied to the work roll bender is sometimes written as "WRB". In addition, F1 to F7 shown in below Tables correspond to the first stand 1 to the seventh stand 7, respectively.

First Embodiment

Assuming a case of manufacturing fine-grained steel through the process of rolling a steel sheet 8 by using the tandem rolling mill 10, the steel sheet having a sheet thickness of 32 mm and a sheet width of 1000 mm before being rolled by the first stand 1, the exit side sheet thicknesses h1 to h7 at a time of rolling the constant portion were determined in S11. The exit side sheet thicknesses [mm] determined are shown in Table 1, together with a rolling load [MN] to be applied to the constant portion of the material to be rolled, WRB [kN/ch] at a time of rolling the front end portion, a rolling reduction position [mm], a tightening load [MN] to be applied to the stand, and a load limit [MN] during kiss roll. Herein, the rolling reduction position refers to a vertical position of a device for applying a tightening load, in which a position during kiss roll of the stand without a load is zero. If the tightening load is made larger than it is when the rolling reduction position is zero, the value of the rolling reduction position becomes minus. The same shall apply hereinafter. Further, "/ch" means "per chock". The same shall apply hereinafter.

TABLE 1

| | F1 | F2 | F3 | F4 | F5 | F6 | F7 |
|---|---|---|---|---|---|---|---|
| Sheet thickness of constant portion [mm] | 18.93 | 12.00 | 8.12 | 5.83 | 4.08 | 2.86 | 2.00 |
| Rolling load on constant portion [MN] | 21.95 | 20.91 | 20.33 | 20.04 | 23.98 | 25.77 | 27.08 |
| WRB [kN/ch] | 980 | 980 | 980 | 980 | 980 | 980 | 980 |
| Rolling reduction position [mm] | 14.45 | 7.73 | 3.97 | 1.74 | −0.81 | −2.40 | −3.53 |
| Tightening load [MN] | — | — | — | — | 3.99 | 11.76 | 17.28 |
| Upper limit of tightening load [MN] | — | — | — | — | 15.68 | 12.74 | 12.74 |

As shown in Table 1, in the draft schedule determined in S11, the tightening load on the seventh stand 7 was 17.28 MN, exceeding the load limit during kiss roll of the seventh stand 7, which was 12.74 MN. So, if the tightening load is pre-applied to the seventh stand 7 as in the draft schedule determined in S11, the seventh stand 7 is likely to break. Therefore in S15, while the exit side sheet thicknesses h1 to h6 were maintained at the value determined in S11, an exit side sheet thickness h7' larger than the exit side sheet thickness h7 was determined so that the tightening load to be applied to the seventh stand 7 would not be larger than the load limit. The exit side sheet thicknesses h1 to h7' [mm] determined in S15 are shown in Table 2, together with a rolling load [MN] to be applied to the front end portion of the material to be rolled, WRB [kN/ch] at a time of rolling the front end portion, a rolling reduction position [mm], a tightening load [MN] to be applied to the stand, and a load limit [MN] during kiss roll.

TABLE 2

| | F1 | F2 | F3 | F4 | F5 | F6 | F7 |
|---|---|---|---|---|---|---|---|
| Sheet thickness of front end portion [mm] | 18.93 | 12.00 | 8.12 | 5.83 | 4.08 | 2.86 | 2.125 |
| Rolling load on front end portion [MN] | 21.95 | 20.91 | 20.33 | 20.04 | 23.98 | 25.77 | 23.14 |
| WRB in front end portion [kN/ch] | 980 | 980 | 980 | 980 | 980 | 980 | 392 |
| Rolling reduction position [mm] | 14.45 | 7.73 | 3.97 | 1.74 | −0.81 | −2.40 | −2.60 |
| Tightening load [MN] | — | — | — | — | 3.99 | 11.76 | 12.73 |
| Upper limit of tightening load [MN] | — | — | — | — | 15.68 | 12.74 | 12.74 |

As shown in Tables 1 and 2, changing h7=2.00 mm into h7'=2.125 mm enabled the tightening load on the seventh stand 7 to be 12.73 MN, which was smaller than the load limit of 12.74 MN. As such, in the operation control method of the present invention according to the first embodiment, when the tightening load to be pre-applied to the fifth stand 5 to the seventh stand 7 exceeds the load limit, the exit side sheet thickness is modified such that the tightening load is not larger than the load limit. Therefore, even when large reduction rolling is carried out in the fifth stand 5 to the seventh stand 7 in order to manufacture fine-grained steel, each of the stands can be prevented from breaking.

Second Embodiment

Assuming a case of manufacturing fine-grained steel through the process of rolling a steel sheet 8 by using the tandem rolling mill 10, the steel sheet having a sheet thickness of 38 mm and a sheet width of 1500 mm before being rolled by the first stand 1, the exit side sheet thicknesses h1 to h7 at a time of rolling the constant portion were determined in S11. The exit side sheet thicknesses [mm] determined are shown in Table 3, together with a rolling load [MN] to be applied to the constant portion of the material to be rolled, WRB [kN/ch] at a time of rolling the front end portion, a rolling reduction position [mm], a tightening load [MN] to be applied to the stand, and a load limit [MN] during kiss roll.

TABLE 3

| | F1 | F2 | F3 | F4 | F5 | F6 | F7 |
|---|---|---|---|---|---|---|---|
| Sheet thickness of constant portion [mm] | 23.70 | 15.70 | 11.01 | 8.15 | 5.54 | 4.10 | 3.20 |
| Rolling load on constant portion [MN] | 24.69 | 23.09 | 21.92 | 20.93 | 37.14 | 32.08 | 30.58 |
| WRB [kN/ch] | 980 | 980 | 980 | 980 | 980 | 980 | 980 |
| Rolling reduction position [mm] | 18.66 | 10.99 | 6.54 | 3.88 | −2.04 | −2.45 | −3.04 |
| Tightening load [MN] | — | — | — | — | 10.00 | 11.99 | 14.90 |
| Upper limit of tightening load [MN] | — | — | — | — | 15.68 | 12.74 | 12.74 |

As shown in Table 3, in the draft schedule determined in S11, the tightening load on the seventh stand 7 was 14.90 MN, exceeding the load limit during kiss roll of the seventh stand 7, which was 12.74 MN. So, if the tightening load is pre-applied to the seventh stand 7 as in the draft schedule determined in S11, the seventh stand 7 is likely to break. Therefore in S15, while the exit side sheet thicknesses h1 to h6 were maintained at the value determined in S11, an exit side sheet thickness h7' larger than the exit side sheet thickness h7 was determined so that the tightening load to be applied to the seventh stand 7 would not be larger than the load limit. The exit side sheet thicknesses h1 to h7' [mm] determined in S15 are shown in Table 4, together with a rolling load [MN] to be applied to the front end portion of the material to be rolled, WRB [kN/ch] at a time of rolling the front end portion, a rolling reduction position [mm], a tightening load [MN] to be applied to the stand, and a load limit [MN] during kiss roll.

TABLE 4

| | F1 | F2 | F3 | F4 | F5 | F6 | F7 |
|---|---|---|---|---|---|---|---|
| Sheet thickness of front end portion [mm] | 23.70 | 15.70 | 11.01 | 8.15 | 5.54 | 4.10 | 3.256 |
| Rolling load on front end portion [MN] | 24.69 | 23.09 | 21.92 | 20.93 | 37.14 | 32.08 | 28.67 |
| WRB in front end portion [kN/ch] | 980 | 980 | 980 | 980 | 980 | 980 | 706 |
| Rolling reduction position [mm] | 18.66 | 10.99 | 6.54 | 3.88 | −2.04 | −2.45 | −2.60 |
| Tightening load [MN] | — | — | — | — | 10.00 | 11.99 | 12.72 |
| Upper limit of tightening load [MN] | — | — | — | — | 15.68 | 12.74 | 12.74 |

As shown in Tables 3 and 4, changing h7=3.20 mm into h7'=3.256 mm enabled the tightening load on the seventh stand 7 to be 12.72 MN, which was smaller than the load limit of 12.74 MN. Therefore, as in the operation control method of the present invention according to the first embodiment, with the operation control method of the present invention according to the second embodiment, even when large reduction rolling is carried out in the fifth stand 5 to the seventh stand 7 in order to manufacture fine-grained steel, each of the stands can be prevented from breaking.

Third Embodiment

Assuming a case of manufacturing fine-grained steel through the process of rolling a steel sheet 8 by using the tandem rolling mill 10, the steel sheet having a sheet thickness of 32 mm and a sheet width of 1300 mm before being rolled by the first stand 1, the exit side sheet thicknesses h1 to h7 at a time of rolling the constant portion were determined in S11. The exit side sheet thicknesses [mm] determined are shown in Table 5, together with a rolling load [MN] to be applied to the constant portion of the material to be rolled, WRB [kN/ch] at a time of rolling the front end portion, a rolling reduction position [mm], a tightening load [MN] to be applied to the stand, and a load limit [MN] during kiss roll.

TABLE 5

| | F1 | F2 | F3 | F4 | F5 | F6 | F7 |
|---|---|---|---|---|---|---|---|
| Sheet thickness of constant portion [mm] | 18.93 | 12.00 | 8.12 | 5.83 | 4.08 | 2.86 | 2.00 |
| Rolling load on constant portion [MN] | 28.54 | 27.19 | 26.42 | 26.05 | 31.17 | 33.50 | 35.21 |
| WRB in front end portion [kN/ch] | 980 | 980 | 980 | 980 | 980 | 980 | 980 |
| Rolling reduction position [mm] | 13.11 | 6.45 | 2.73 | 0.51 | −2.28 | −3.98 | −5.18 |
| Tightening load [MN] | — | — | — | — | 11.18 | 19.49 | 25.41 |
| Upper limit of tightening load [MN] | — | — | — | — | 15.68 | 12.74 | 12.74 |

As shown in Table 5, in the draft schedule determined in Sil, the tightening load on the sixth stand 6 was 19.49 MN and the tightening load on the seventh stand 7 was 25.41 MN, respectively exceeding the load limit during kiss roll of the sixth stand 6, which was 12.74 MN, and the load limit during kiss roll of the seventh stand 7, which was 12.74 MN. So, if the tightening load is pre-applied to the sixth stand 6 and to the seventh stand 7 as in the draft schedule determined in S11, the sixth stand 6 and the seventh stand 7 are likely to break. Therefore in S15, while the exit side sheet thicknesses h1 to h5 were maintained at the value determined in S11, an exit side sheet thickness h6' larger than the exit side sheet thickness h6, and an exit side sheet thickness h7' larger than the exit side sheet thickness h7 were determined so that the tightening load to be applied to the sixth stand 6 and to the seventh stand 7 would not be larger than the load limit. The exit side sheet thicknesses h1 to h7' [mm] determined in S15 are shown in Table 6, together with a rolling load [MN] to be applied to the front end portion of the material to be rolled, WRB [kN/ch] at a time of rolling the front end portion, a rolling reduction position [mm], a tightening load [MN] to be applied to the stand, and a load limit [MN] during kiss roll.

TABLE 6

| | F1 | F2 | F3 | F4 | F5 | F6 | F7 |
|---|---|---|---|---|---|---|---|
| Sheet thickness of front end portion [mm] | 18.93 | 12.00 | 8.12 | 5.83 | 4.08 | 3.13 | 2.28 |
| Rolling load on front end portion [MN] | 28.54 | 27.19 | 26.42 | 26.05 | 31.17 | 28.09 | 23.44 |
| WRB in front end portion [kN/ch] | 980 | 980 | 980 | 980 | 980 | 584 | 78 |
| Rolling reduction position [mm] | 13.11 | 6.45 | 2.73 | 0.51 | −2.28 | −2.60 | −2.60 |
| Tightening load [MN] | — | — | — | — | 11.18 | 12.72 | 12.72 |
| Upper limit of tightening load [MN] | — | — | — | — | 15.68 | 12.74 | 12.74 |

As shown in Tables 5 and 6, changing h6=2.86 mm into h6'=3.13 mm enabled the tightening load on the sixth stand 6 to be 12.72 MN, which was smaller than the load limit of 12.74 MN. Further, changing h7=2.00 mm into h7'=2.28 mm enabled the tightening load on the seventh stand 7 to be 12.72 MN, which was smaller than the load limit of 12.74 MN. Therefore, as in the operation control method of the present invention according to the first and second embodiments, with the operation control method of the present invention according to the third embodiment, even when large reduction rolling is carried out in the fifth stand 5 to the seventh stand 7 in order to manufacture fine-grained steel, each of the stands can be prevented from breaking.

Fourth Embodiment

Assuming a case of manufacturing fine-grained steel through the process of rolling a steel sheet 8 by using the tandem rolling mill 10, the steel sheet having a sheet thickness of 32 mm and a sheet width of 1000 mm before being rolled by the first stand 1, the exit side sheet thicknesses h1 to h7 at a time of rolling the constant portion were determined in S11. The exit side sheet thicknesses [mm] determined are shown in Table 7, together with a rolling load [MN] to be applied to the constant portion of the material to be rolled, WRB [kN/ch] at a time of rolling the front end portion, a rolling reduction position [mm], a tightening load [MN] to be applied to the stand, and a load limit [MN] during kiss roll.

TABLE 7

| | F1 | F2 | F3 | F4 | F5 | F6 | F7 |
|---|---|---|---|---|---|---|---|
| Sheet thickness of constant portion [mm] | 17.35 | 10.41 | 6.66 | 4.66 | 3.27 | 2.29 | 1.60 |
| Rolling load on constant portion [MN] | 23.64 | 21.99 | 21.68 | 20.53 | 23.47 | 26.78 | 31.02 |
| WRB in front end portion [kN/ch] | 980 | 980 | 980 | 980 | 980 | 980 | 1470 |
| Rolling reduction position [mm] | 12.53 | 5.92 | 2.24 | 0.47 | −1.52 | −3.18 | −4.73 |
| Tightening load [MN] | — | — | — | — | 7.47 | 15.58 | 23.18 |
| Upper limit of tightening load [MN] | — | — | — | — | 15.68 | 12.74 | 12.74 |

As shown in Table 7, in the draft schedule determined in S11, the tightening load on the sixth stand 6 was 15.58 MN and the tightening load on the seventh stand 7 was 23.18 MN, respectively exceeding the load limit during kiss roll of the sixth stand 6, which was 12.74 MN, and the load limit during kiss roll of the seventh stand 7, which was 12.74 MN. So, if the tightening load is pre-applied to the sixth stand 6 and to the seventh stand 7 as in the draft schedule determined in S11, the sixth stand 6 and the seventh stand 7 are likely to break. Therefore in S15, while the exit side sheet thicknesses h1 to h5 were maintained at the value determined in S11, an exit side sheet thickness h6' larger than the exit side sheet thickness h6 and an exit side sheet thickness h7' larger than the exit side sheet thickness h7 were determined so that the tightening load to be applied to the sixth stand 6 and to the seventh stand 7 would not be larger than the load limit. The exit side sheet thicknesses h1 to h7' [mm] determined in S15 are shown in Table 8, together with a rolling load [MN] to be applied to the front end portion of the material to be rolled, WRB [kN/ch] at a time of rolling the front end portion, a rolling reduction position [mm], a tightening load [MN] to be applied to the stand, and a load limit [MN] during kiss roll.

TABLE 8

| | F1 | F2 | F3 | F4 | F5 | F6 | F7 |
|---|---|---|---|---|---|---|---|
| Sheet thickness of front end portion [mm] | 17.35 | 10.41 | 6.66 | 4.66 | 3.27 | 2.39 | 1.81 |

TABLE 8-continued

| | F1 | F2 | F3 | F4 | F5 | F6 | F7 |
|---|---|---|---|---|---|---|---|
| Rolling load on front end portion [MN] | 23.64 | 21.99 | 21.68 | 20.53 | 23.47 | 24.45 | 21.58 |
| WRB in front end portion [kN/ch] | 980 | 980 | 980 | 980 | 980 | 681 | 260 |
| Rolling reduction position [mm] | 12.53 | 5.92 | 2.24 | 0.47 | −1.52 | −2.60 | −2.60 |
| Tightening load [MN] | — | — | — | — | 7.47 | 12.72 | 12.72 |
| Upper limit of tightening load [MN] | — | — | — | — | 15.68 | 12.74 | 12.74 |

As shown in Tables 7 and 8, changing h6=2.29 mm into h6'=2.39 mm enabled the tightening load on the sixth stand 6 to be 12.72 MN, which was smaller than the load limit of 12.74 MN. Further, changing h7=1.60 mm into h7'=1.81 mm enabled the tightening load on the seventh stand 7 to be 12.72 MN, which was smaller than the load limit of 12.74 MN. Therefore, as in the operation control method of the present invention according to the first to third embodiments, with the operation control method of the present invention according to the fourth embodiment, even when large reduction rolling is carried out in the fifth stand 5 to the seventh stand 7 in order to manufacture fine-grained steel, each of the stands can be prevented from breaking.

As described above, when the tightening load to be pre-applied exceeds the load limit, the exit side thickness is increased, thereby enabling the tightening load to be not larger than the load limit. However, as indicated in Tables 1 to 8, if the exit side sheet thickness is changed from h6 to h6', or from h7 to h7', the force (rolling load) to be applied to the steel sheet 8 will change accordingly. If the rolling load changes, the amount of flexure of the work roll will change, likely causing the shape of the steel sheet 8 to be unstable. Therefore, in the operation control method of the present invention, it is preferable to modify the operation of the shape control device provided to the stand (for example, actuators 5*x*, 6*x*, 7*x*, and bender devices 5*y*, 6*y*, 7*y*; the same shall apply hereinafter), in order to inhibit the change in the shape caused by the change in the rolling load. In the operation control method of the present invention, since the exit side sheet thickness is changed (for example, from h7' to h7) to change the tightening load within a short time after completing rolling of the front end portion, it may not be possible to carry out the sensor feedback type shape control in time. Therefore, in the operation control method of the present invention, it is preferable to modify the operation of the shape control device while monitoring the tightening load.

In the operation control method of the present invention, when the speed at which the tightening load is modified in association with the change in the exit side sheet thickness is so fast that the speed of operating the shape control device such as the actuators 5*x*, 6*x*, 7*x* cannot follow it, it is preferable to predict in advance a necessary amount of control of the bender devices 5*y*, 6*y*, 7*y*, and to carry out an initial setting of the shape control device in a way that does not cause the amount of control of the bender devices 5*y*, 6*y*, 7*y* to exceed a permissible range at a time of transition from the front end portion to the constant portion of the steel sheet 8.

Further, in the operation control method of the present invention, when the speed at which the tightening load is modified in association with the change in the exit side sheet thickness is slow enough for the speed of operating the shape control device such as the actuators 5*x*, 6*x*, 7*x* to follow, a distribution of the amount of control of the actuators 5*x*, 6*x*, 7*x* and the amount of control of the bender devices 5*y*, 6*y*, 7*y* may be changed to thereby ensure flatness of the steel sheet 8. When it is predicted that the amount of control of the bender devices 5*x*, 6*x*, 7*x* would be over the permissible range, the amount of control of the actuators 5*x*, 6*x*, 7*x* may be modified in a way that prevents the amount of control of the bender devices 5*y*, 6*y*, 7*y* from being over the permissible range, to thereby ensure flatness of the steel sheet 8.

Figure 3:
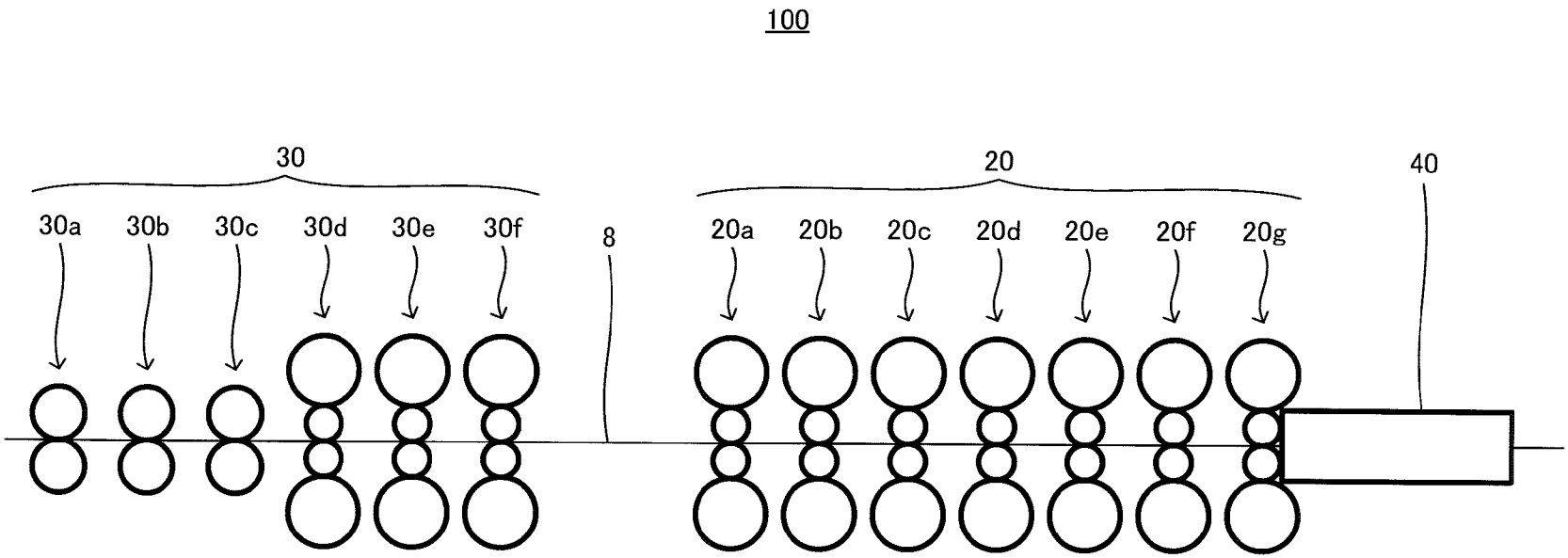
FIG. 3 is a view showing a configuration example of a manufacturing line 100 of a hot-rolled steel sheet comprising a row 20 of finishing mills the operation of which is controlled by the method of controlling operation of a tandem rolling mill according to the present invention.

FIG. 3 shows a configuration example of the manufacturing line 100 of a hot-rolled steel sheet comprising a row 20 of finishing mills the operation of which is controlled by the operation control method of the present invention. In FIG. 3, the manufacturing line 100 of a hot-rolled steel sheet is only partially shown, and descriptions of the control device and the like provided to the row 20 of finishing mills are omitted. As shown in FIG. 3, the manufacturing line 100 of a hot-rolled steel sheet comprises: a row 30 of roughing mills comprising roughing mills 30*a*, 30*b*, . . . , 30*f*; and the row 20 of finishing mills comprising finishing mills 20*a*, 20*b*, . . . , 20*g*. The row 20 of finishing mills comprises seven stands from the first stand 20*a* to the seventh stand 20*g*, and the operation of the row 20 of finishing mills is controlled through above S1 comprising S11 to S16. Therefore, the row 20 of finishing mills can be operated for example with the rolling reduction in the three latter-stage stands (the fifth stand 20*e*, the sixth stand 20*f*, and the seventh stand 20*g*) set larger than the rolling reduction in manufacturing a steel sheet other than ultrafine-grained steel. Thereby, it is possible to cause large deformation to the austenite grains in the steel sheet 8 and to increase the dislocation density. In this manner, fine-grained steel can be manufactured by controlling the operation of the row 20 of finishing mills in the manufacturing line 100 of a hot rolled steel sheet with the operation control method of the present invention.

As described above, according to the present invention, it is possible to provide a method of controlling operation of a tandem rolling mill which enables manufacturing of fine-grained steel and a method of manufacturing a hot-rolled steel sheet which enables manufacturing of fine-grained steel.

The average linear load of the rolling load in the latter-stage stand for producing fine-grained steel is a value obtained by dividing the rolling load on the constant portion shown in Tables 3, 5, and 7 by the sheet width, and exceeds 20 MN/m. This is higher compared with the rolling load of an ordinary draft schedule for conventional cases. By realizing this high load rolling, it is possible to manufacture fine-grained steel within the upper limit range of the tightening load even in the case of a finished material having a relatively small sheet thickness and a relatively large width, as demonstrated in the first to fourth embodiments.

EXAMPLES

A steel sheet having a sheet thickness of 32 mm and a sheet width of 1000 mm before being rolled by the first stand 1 was rolled by a tandem rolling mill constituted by seven stands. The rolling conditions were set as Conditions 1 to 4 shown in Table 9.

TABLE 9

| | Setting of front end portion | | Setting of constant portion | | | |
|---|---|---|---|---|---|---|
| Condition | Gap | WRB | Gap | WRB | Evaluation | Note |
| 1 | Table 2 | Table 2 | Table 1 | Table 1 | No breakage of the rolling mill; No shape defects of the rolled material | Example of the present invention |
| 2 | Table 1 | Table 1 | Table 1 | Table 1 | Trouble of abnormal heat generation occured in the drive system (pinion) of the rolling mill | Conventional technique |
| 3 | Table 2 | Table 2 | Table 1 | Table 2 | No breakage of the rolling mill; Shape defect was found in the constant portion of the rolled material | |
| 4 | Table 2 | Table 1 | — | — | No breakage of the rolling mill; Shape defect was found in the front end portion; Trouble in sheet passing occured | |

In Condition 1, a front end portion of the steel sheet was rolled in the setting shown in Table 2; and a constant portion of the steel sheet was rolled in the setting shown in Table 1. By decreasing the gap in the seventh stand to the setting in Table 1 after rolling the front end portion in the setting shown in Table 2, it was possible to achieve the target sheet thickness in the constant portion. Furthermore, by changing a bending force to be applied to a work roll bender, which is a shape control device capable of high-speed operation while monitoring the load in the seventh stand, from 392 kN/cn shown in Table 2 to 980 kN/cn shown in Table 1, it was possible to carry out rolling without ruining the shape on the exit side of the seventh stand. That is, according to the present invention, it was possible to start controlling the operation of the tandem rolling mill under the state of kiss roll and to manufacture fine-grained steel.

In Condition 2 on the other hand, the front end portion was rolled with the setting of the gap shown in Table 1 by using a conventional technique, and abnormal heat was generated due to the torque circulation in a pinion part to transmit a drive force of a rolling mill motor to the upper and lower work rolls. Therefore, rolling had to be stopped halfway.

Further in Condition 3, the front end portion was rolled at the set value shown in Table 2, and thereafter the rolling mill gap was changed to the set value shown in Table 1, but WRB was kept at the value shown in Table 2. Therefore, the rolling mill did not break, but there was a large defect in the shape of the constant portion of the rolled material, leading to loss of product values.

Furthermore in Condition 4, the gap was set as shown in Table 2 and WRB was set at the value shown in Table 1. However, a defect in the shape at the time of passing through the seventh stand caused the front end portion of the coil to get stuck on the exit side of the rolling mill, making it unable to reach a coiling device, which is usually arranged on the downstream side of the rolling mill. Therefore, the rolling mill had to be stopped.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a method of controlling operation of a tandem rolling mill and a method of manufacturing a hot-rolled steel sheet with such modifications are also encompassed within the technical range of the invention.

INDUSTRIAL APPLICABILITY

The method of controlling operation of a tandem rolling mill of the present invention and the method of manufacturing a hot-rolled steel sheet of the present invention can be employed in manufacturing a hot-rolled steel sheet having fine crystal grains. Further, the hot-rolled steel sheet having fine crystal grains can be used as a material for automobiles, household electric appliances, machine structures, building constructions, and other purposes.

DESCRIPTION OF THE SYMBOLS

1 first stand
1*x* actuator
1*y* bender device
2 second stand
2*x* actuator
2*y* bender device
3 third stand
3*x* actuator
3*y* bender device
4 fourth stand
4*x* actuator
4*y* bender device
5 fifth stand
5*x* actuator
5*y* bender device
6 sixth stand
6*x* actuator
6*y* bender device
7 seventh stand
7*x* actuator
7*y* bender device
8 material to be rolled (steel sheet)
10 tandem rolling mill
20 row of finishing mills
30 row of roughing mills
100 manufacturing line of hot-rolled steel sheet

The invention claimed is:

1. A method of controlling operation of a tandem rolling mill which comprises N stands (N being an integer of 2 or more) and in which a tightening load is pre-applied to each of the (N−m+1)-th stand (m being an integer of one or more and N or less) to the N-th stand before a material to be rolled is fed thereinto, the method comprising an exit side sheet thickness determination step of determining a sheet thickness on an exit side of each of the first stand to the N-th stand, wherein the exit side sheet thickness determination step comprises: a first exit side sheet thickness determination step of determining sheet thicknesses on the exit sides of the first stand to the N-th stand in rolling a constant portion of the material to be rolled; and a second exit side sheet thickness determination step of determining sheet thicknesses on the exit sides of the first stand to the N-th stand in rolling a front end portion of the material to be rolled, such that the tightening load to be pre-applied to the stands becomes a preset tightening load or less;

the material to be rolled is rolled to have the exit side sheet thickness determined in the second exit side sheet thickness determination step, until at least the front end portion of the material to be rolled is fed into each of the stands;

the constant portion of the material to be rolled is rolled by the (N−m+1)-th stand to the N-th stand to have the exit side sheet thickness determined in the first exit side sheet thickness determination step; and the sheet thicknesses on the exit sides of the (N−m+1)-th stand to the N-th stand determined in the second exit side sheet thickness determination step are larger than the sheet thicknesses on the exit sides of the same stands determined in the first exit side sheet thickness determination step.

2. The method of controlling operation of a tandem rolling mill according to claim 1, wherein in transition from the front end portion to the constant portion of the material to be rolled, a change in the shape of the stand is predicted based on a change in a rolling load from the front end portion to the constant portion; and operation of a shape control device of the stand is controlled based on the predicted change in the shape.

3. The method of controlling operation of a tandem rolling mill according to claim 1, wherein the stands to be pre-applied with the tightening load comprise two or more shape control devices;

the two or more shape control devices include a first shape control device and a second shape control device which is capable of high-speed operation at least at the time of transition from the front end portion to the constant portion of the material to be rolled;

the operation of the second shape control device is predicted before the transition from the front end portion to the constant portion of the material to be rolled; and based on the prediction result, the operations of the first shape control device and the second shape control device are set such that a permissible operation range of the second shape control device is not exceeded.

4. The method of controlling operation of a tandem rolling mill according to claim 1, wherein the stands to be pre-applied with the tightening load comprise a first shape control device and a second shape control device which are capable of high-speed operation at least at the time of transition from the front end portion to the constant portion of the material to be rolled; and in a case when a permissible operation range of the first shape control device is exceeded, the operation of the second shape control device is modified.

5. The method of controlling operation of a tandem rolling mill according to claim 1, wherein the exit side sheet thickness determination step further comprises a third exit side sheet thickness determination step of determining sheet thicknesses on the exit sides of the first stand to the N-th stand such that the tightening load on the stands at a time of completing rolling of a back end portion of the material to be rolled becomes a preset tightening load or less.

6. A method of manufacturing a hot-rolled steel sheet comprising the step of rolling a steel sheet by using a row of hot finishing mills the operation of which is controlled by the method of controlling operation of a tandem rolling mill according to claim 1.

* * * * *